US008499725B2

(12) United States Patent
Lee et al.

(10) Patent No.: US 8,499,725 B2
(45) Date of Patent: Aug. 6, 2013

(54) VARIABLE COMPRESSION RATIO APPARATUS

(75) Inventors: Dong Seok Lee, Suwon-si (KR); Jei Choon Yang, Yongin-si (KR); Yen Wha Ryu, Hwaseong-si (KR); Eun Ho Lee, Hwaseong-si (KR); Young Hong Kwak, Suwon-si (KR); Jin Kook Kong, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 336 days.

(21) Appl. No.: 12/946,160

(22) Filed: Nov. 15, 2010

(65) Prior Publication Data

US 2012/0042854 A1 Feb. 23, 2012

(30) Foreign Application Priority Data

Aug. 23, 2010 (KR) ..... 10-2010-0081509

(51) Int. Cl.
*F02B 75/04* (2006.01)
*F02B 1/00* (2006.01)

(52) U.S. Cl.
USPC .... 123/48 R; 123/48 B; 123/78 R; 123/78 B; 123/78 BA; 123/78 E

(58) Field of Classification Search
USPC ..... 123/48 R, 48 B, 78 R, 78 B, 78 BA, 123/78 E
See application file for complete search history.

(56) References Cited

U.S. PATENT DOCUMENTS 4,876,992 A * 10/1989 Sobotowski ..... 123/48 R
6,581,552 B2 * 6/2003 Kreuter ..... 123/48 R

* cited by examiner

*Primary Examiner* — Lindsay Low
*Assistant Examiner* — Charles Brauch
(74) *Attorney, Agent, or Firm* — Morgan, Lewis & Bockius LLP

(57) ABSTRACT

A variable compression ratio apparatus may include a connecting rod provided with one end formed of a mounting hole and the other end eccentrically and rotatably connected to a crankshaft, wherein a piston pin may be inserted in the mounting hole and the connecting rod may be rotatably connected to the piston through the piston pin, an eccentric link provided with an eccentric bearing concentrically and rotatably mounted in the mounting hole may be connected and, the piston pin being eccentrically and rotatably mounted in the eccentric bearing, a variable link pivotally connected to the eccentric link, a variable gear link pivotal with respect to a fixed shaft and having a first gear teeth at an exterior circumference thereof, an external circumferential portion thereof being rotatably connected to the variable link, and a control shaft formed of a second gear teeth engaged to the first gear teeth.

14 Claims, 4 Drawing Sheets

VARIABLE COMPRESSION RATIO APPARATUS

CROSS-REFERENCE TO RELATED APPLICATION

The present application claims priority to Korean Patent Application No. 10-2010-0081509 filed in the Korean Intellectual Property Office on Aug. 23, 2010, the entire contents of which is incorporated herein for all purposes by this reference.

BACKGROUND OF THE INVENTION

1. Field of the Invention

The present invention relates to a variable compression ratio apparatus. More particularly, the present invention relates to a variable compression ratio apparatus which changes compression ratio of an air-fuel mixture in a combustion chamber according to a driving condition of an engine.

2. Description of Related Art

Generally, thermal efficiency of combustion engines increases as the compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

According to a conventional variable compression ratio apparatus, a variable compression ratio is achieved by changing a length of a connecting rod which connects a piston to a crankshaft. Such types of a variable compression ratio apparatus include a plurality of links connecting a piston with the crankshaft, and combustion force is directly transmitted to the links. So, durability of the links deteriorates.

It becomes known to a person skilled in the art through various experimental results conducted to a conventional variable compression ratio apparatus that operation reliability is high in a case that a distance between a crank pin and a piston pin is changed by using an eccentric bearing. If hydraulic pressure, however, is used for rotating the eccentric bearing, a rotating angle of the eccentric bearing in each cylinder or hydraulic pressure applied to each cylinder is different. So, a compression ratio in a cylinder is different from that in another cylinder and a time required for changing the compression ratio according to the driving condition of the engine is varied in each cylinder.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus having advantages of changing compression ratio of an air-fuel mixture as a consequence of mounting an eccentric bearing in a small end portion of a connecting rod and rotating the eccentric bearing by using link members.

In addition, another objective of the present invention is that combustion force of the air-fuel mixture transmitted to the link members is minimized by kinematically separating a connecting rod from the link members.

A variable compression ratio apparatus in an aspect of the present invention may be mounted at an engine receiving combustion force of an air-fuel mixture from a piston and rotating a crankshaft, and changes compression ratio of the air-fuel mixture.

The variable compression ratio apparatus may include a connecting rod provided with one end formed of a mounting hole and the other end eccentrically and rotatably connected to the crankshaft, wherein a piston pin may be inserted in the mounting hole and the one end of the connecting rod may be rotatably connected to the piston through the piston pin, an eccentric link provided with one end to which an eccentric bearing concentrically and rotatably mounted in the mounting hole may be connected and the other end, the piston pin being eccentrically and rotatably mounted in the eccentric bearing, a variable link provided with one end rotatably connected to the other end of the eccentric link and the other end, a variable gear link configured to pivot with respect to a fixed shaft and formed of a first gear teeth at an exterior circumference thereof, an external circumferential portion thereof being rotatably connected to the other end of the variable link, and a control shaft formed of a second gear teeth engaged to the first gear teeth at an exterior circumference thereof and rotating so as to pivot the variable gear link.

The pivoting movement of the variable gear link according to the rotation of the control shaft may rotate the eccentric link through the variable link.

The variable gear link may have fan shape, and the fixed shaft may be positioned near a vertex of the fan shape.

The variable link may further include first and second variable links, wherein the first variable link connects a side surface of the eccentric link with a side surface of the variable gear link, and the second variable link connects the other side surface of the eccentric link with the other side surface of the variable gear link.

A plurality of balance weights for reducing rotational vibration may be mounted at the crankshaft, and the connecting rod, the eccentric link, the variable link, and the variable gear link may be disposed between a pair of balance weights.

A portion of the balance weight may be trimmed considering movement traces of the eccentric link and the variable link and movement traces of corresponding crank pin and balance weight.

A variable compression ratio apparatus in another aspect of the present invention may include a connecting rod provided with one end formed of a mounting hole and the other end rotatably connected to the crankshaft so as to transmit the combustion force of the air-fuel mixture received from the piston to the crankshaft, a control shaft rotating according to a driving condition of the engine, a variable gear link pivoting with respect to a fixed shaft by the rotation of the control shaft, an eccentric link provided with one end connected to an eccentric bearing which may be concentrically and rotatably mounted in the mounting hole, a variable link connecting the other end of the eccentric link to the variable gear link and rotating the eccentric link with respect to the eccentric bearing by pivoting movement of the variable gear link, and a piston pin eccentrically inserted in the eccentric bearing and mounted in the piston so as to rotatably connect the eccentric link and the connecting rod to the piston.

The variable gear link may have fan shape, and the fixed shaft may be positioned near a vertex of the fan shape.

A first gear teeth may be formed at an exterior circumference of the variable gear link, and a second gear teeth engaging with the first gear teeth may be formed at an exterior circumference of the control shaft.

The variable link may include first and second variable links, wherein the first variable link connects a side surface of the eccentric link with a side surface of the variable gear link, and the second variable link connects the other side surface of the eccentric link with the other side surface of the variable gear link.

A plurality of balance weights for reducing rotational vibration may be mounted at the crankshaft, and the connecting rod, the eccentric link, the variable link, and the variable gear link may be disposed between a pair of balance weights.

A portion of the balance weight may be trimmed considering movement traces of the eccentric link and the variable link and movement traces of corresponding crank pin and balance weight.

Movements of the eccentric link and the variable link may be limited by the connecting rod, a crank pin, and a trimmed portion of the balance weight so as to prevent collision therebetween.

The eccentric bearing may be integrally formed with the eccentric link.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
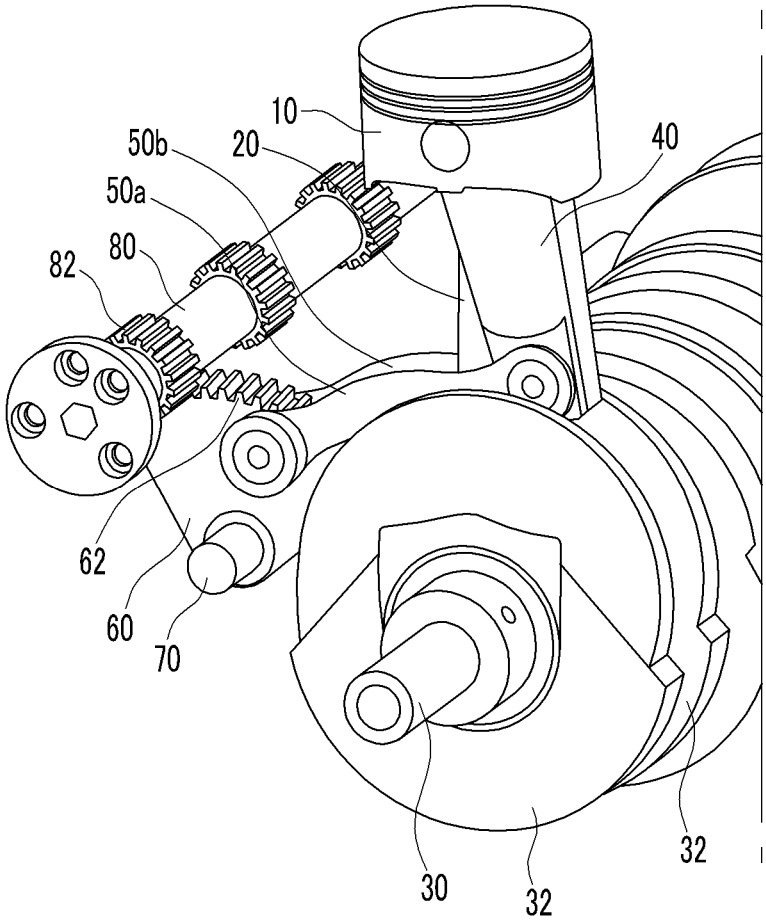
FIG. 1 is a perspective view of a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
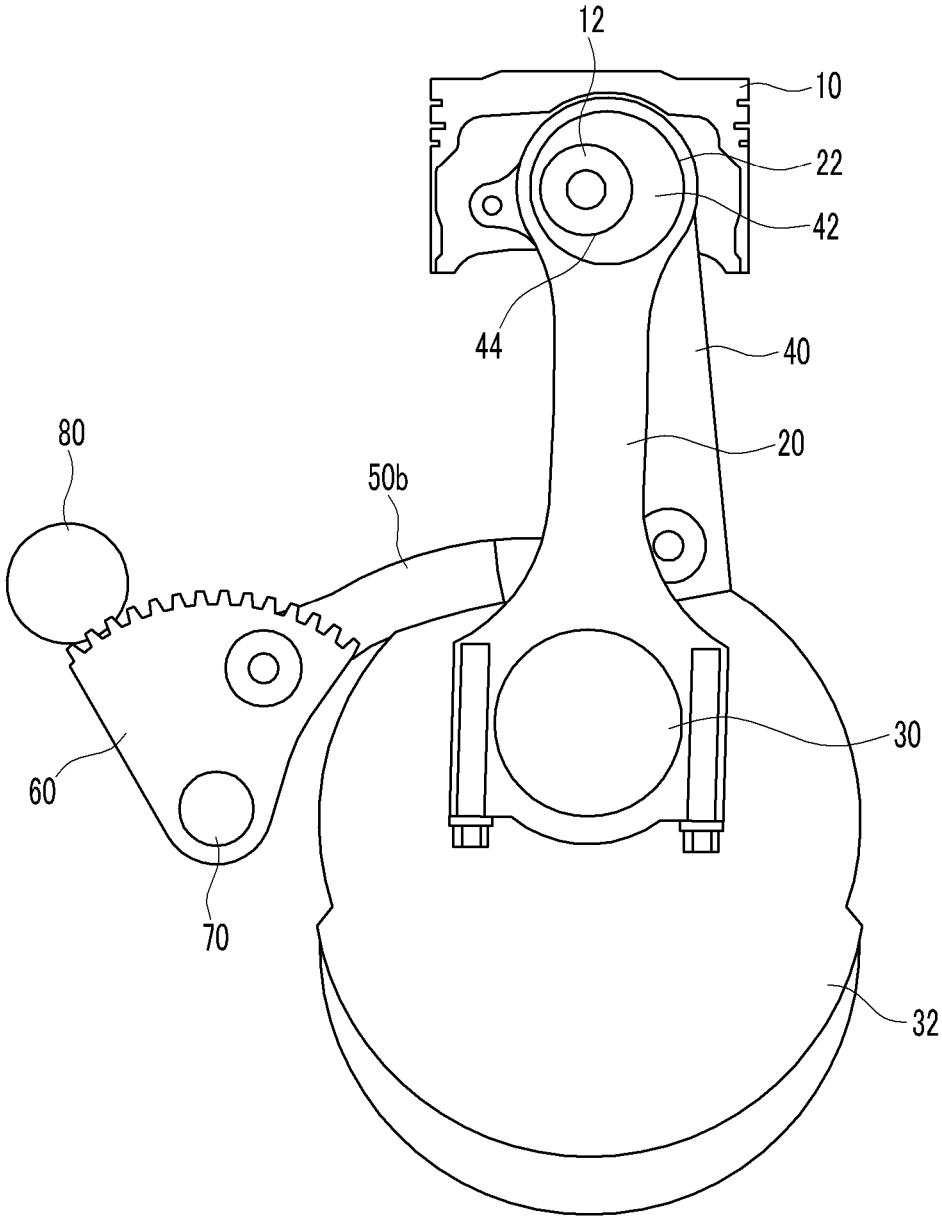
FIG. 2 is a cross-sectional view of a variable compression ratio apparatus according to an exemplary embodiment of the present invention.

FIG. 1 is a perspective view of a variable compression ratio apparatus according to an exemplary embodiment of the present invention, and FIG. 2 is a cross-sectional view of a variable compression ratio apparatus according to an exemplary embodiment of the present invention.

As shown in FIG. 1 and FIG. 2, a variable compression ratio apparatus according to an exemplary embodiment of the present invention is mounted at an engine which receives combustion force of an air-fuel mixture from a piston 10 and rotates a crankshaft 30. The variable compression ratio apparatus changes compression ratio of the air-fuel mixture according to a driving condition of the engine.

The piston 10 moves upward or downward in a cylinder and a combustion chamber is formed between the piston 10 and a cylinder.

The crankshaft 30 receives the combustion force from the piston 10 and transmits torque to a transmission after converting the combustion force into the torque. The crankshaft 30 is mounted in a crank case formed at a lower portion of the cylinder. In addition, a plurality of balance weights 32 is mounted at the crankshaft 30. Such the balance weight 32 reduces rotational vibration generated when the crankshaft 30 rotates.

The variable compression ratio apparatus 1 includes a connecting rod 20, an eccentric link 40, first and second variable links 50*a* and 50*b*, a variable gear link 60, and a control shaft 80.

The connecting rod 20 receives the combustion force from the piston 10 and transmits the combustion force to the crankshaft 30. The connecting rod 20 is similar to a conventional connecting rod. For this purpose, one end of the connecting rod 20 is rotatably connected to the piston 10 through a piston pin 12, and the other end of the connecting rod 20 is eccentrically and rotatably connected to the crankshaft 30. Generally, the one end of the connecting rod 20 connected to the piston 10 is called a small end, and the other end of the connecting rod 20 connected to the crankshaft 30 is called a big end. In addition, a mounting hole 22 is formed at the one end (i.e., small end) of the connecting rod 20. Since the connecting rod 20 similar to the conventional connecting rod is used, a structure of a conventional engine may not be changed so as to mount the variable compression ratio apparatus. In addition, durability of link members forming the variable compression ratio apparatus may be improved by transmitting the combustion force of the air-fuel mixture mostly to the connecting rod 20.

The eccentric link 40 has both ends, and one end of the eccentric bearing link 40 is rotatably connected to the one end of the connecting rod 20. For this purpose, an eccentric bearing 42 is connected to or is integrally formed with the one end of the eccentric link 40, and the eccentric bearing 42 is concentrically mounted in the mounting hole 22. A pin mounting hole 44 is formed at the eccentric bearing 42. The pin mounting hole 44 is eccentric to the eccentric bearing 42. The piston pin 12 is inserted in the pin mounting hole 44 so as to rotatably connect the connecting rod 20 and the eccentric link 40 to the piston 10. That is, a central axis of the eccentric bearing 42, which is the same as a central axis of the mounting hole 22, is parallel to the piston pin 12 and is disposed apart from the piston pin 12 by a predetermined distance. Therefore, if the eccentric bearing 42 rotates, a relative position of a center of the piston pin 12 to a center of the mounting hole 22 changes, and thereby, a relative position of the piston pin 12 to a crank pin (30) changes. Therefore, the compression ratio of the air-fuel mixture is changed. It is exemplarily shown in this specification that the eccentric bearing 42 is integrally formed with the eccentric link 40, but the scope of the present invention is not limited to this. That is, the eccentric bearing 42 and the eccentric link 40 may be manufactured separately and then be assembled. In addition, it is exemplarily shown in this specification that a pair of eccentric links 40 is provided and the connecting rod 20 is disposed between the pair of eccentric links 40, but the scope of the present invention is not limited to this. That is, one or more eccentric link 40 can be used.

The variable links 50*a* and 50*b* rotates the eccentric link 40 with respect to the eccentric bearing 42. For this purpose, the variable links 50*a* and 50*b* are respectively provided with both ends, and one end of the variable links 50*a* and 50*b* is rotatably connected to the other end of the eccentric link 40. It is exemplarily shown in this specification that a pair of variable links 50*a* and 50*b* is used, but the scope of the present invention is not limited to this. That is, one or more variable link 50*a* and 50*b* can be used. In addition, the number of the variable link 50*a* and 50*b* may be the same that of the eccentric link 40 or not.

The variable gear link 60 has fan shape, and a fixed shaft 70 is mounted near a vertex of the fan shape. Therefore, the variable gear link 60 can pivot with respect to the fixed shaft 70. The pivoting movement of the variable gear link 60 rotates the eccentric link 40 with respect to the eccentric bearing 42 through the variable links 50*a* and 50*b*. For this purpose, the other end of the variable links 50*a* and 50*b* is rotatably connected to an external circumferential portion of the variable gear link 60. In addition, a first gear teeth 62 is formed at an exterior circumference of the variable gear link 60.

The control shaft 80 rotates according to the driving condition of the engine and pivots the variable gear link 60. For this purpose, a second gear teeth 82 engaged with the first gear teeth 62 of the variable gear link 60 is formed at an exterior circumference of the control shaft 80. In addition, the control shaft 80 is connected to an actuator such as a motor, and an operation of the actuator is controlled by a control portion. Therefore, if the control portion decides the compression ratio of the air-fuel mixture according to the driving condition of the engine, the control portion operates the actuator. The control shaft 80 rotates by the operation of the actuator and changes the compression ratio of the air-fuel mixture.

The variable compression ratio apparatus according to an exemplary embodiment of the present invention operates independently from the rotation of the crankshaft 30. Therefore, the link members used in variable compression ratio apparatus may collide with the crankshaft 30. Particularly, a connecting portion of the eccentric link 40 and the variable links 50*a* and 50*b* have high possibility of colliding with the balance weight 32 of the crankshaft 30 considering a movement trace thereof. In addition, when the engine operates, the eccentric link 40 and the variable links 50*a* and 50*b* moves from side to side and may be disassembled. To solve such a problem, the connecting rod 20, the eccentric link 40, the variable links 50*a* and 50*b*, and the variable gear link 60 are disposed between a pair of balance weights 32. In addition, a specific portion of the crankshaft 30 such as the balance weight 32 is trimmed so as to secure an operational region of the variable compression ratio apparatus and guide the connecting portion of the eccentric link 40 and the variable links 50*a* and 50*b*. The specific portion can be easily set by a person of an ordinary skill in the art considering a movement trace of the eccentric link 40 and the variable links 50*a* and 50*b* and a movement trace of corresponding balance weight 32. Further, some portion of the eccentric link 40 and the variable links 50*a* and 50*b* may be always disposed between the connecting rods 20 and the balance weights 32 not to be disassembled during the variable compression ratio apparatus operates.

Meanwhile, rotatable connection of the links means in this specification that the links are connected to each other though connecting means such as a pin and enable of relative rotation.

Hereinafter, an operation of the variable compression ratio apparatus according to an exemplary embodiment of the present invention will be described in detail with reference to FIG. 3.

Figure 3:
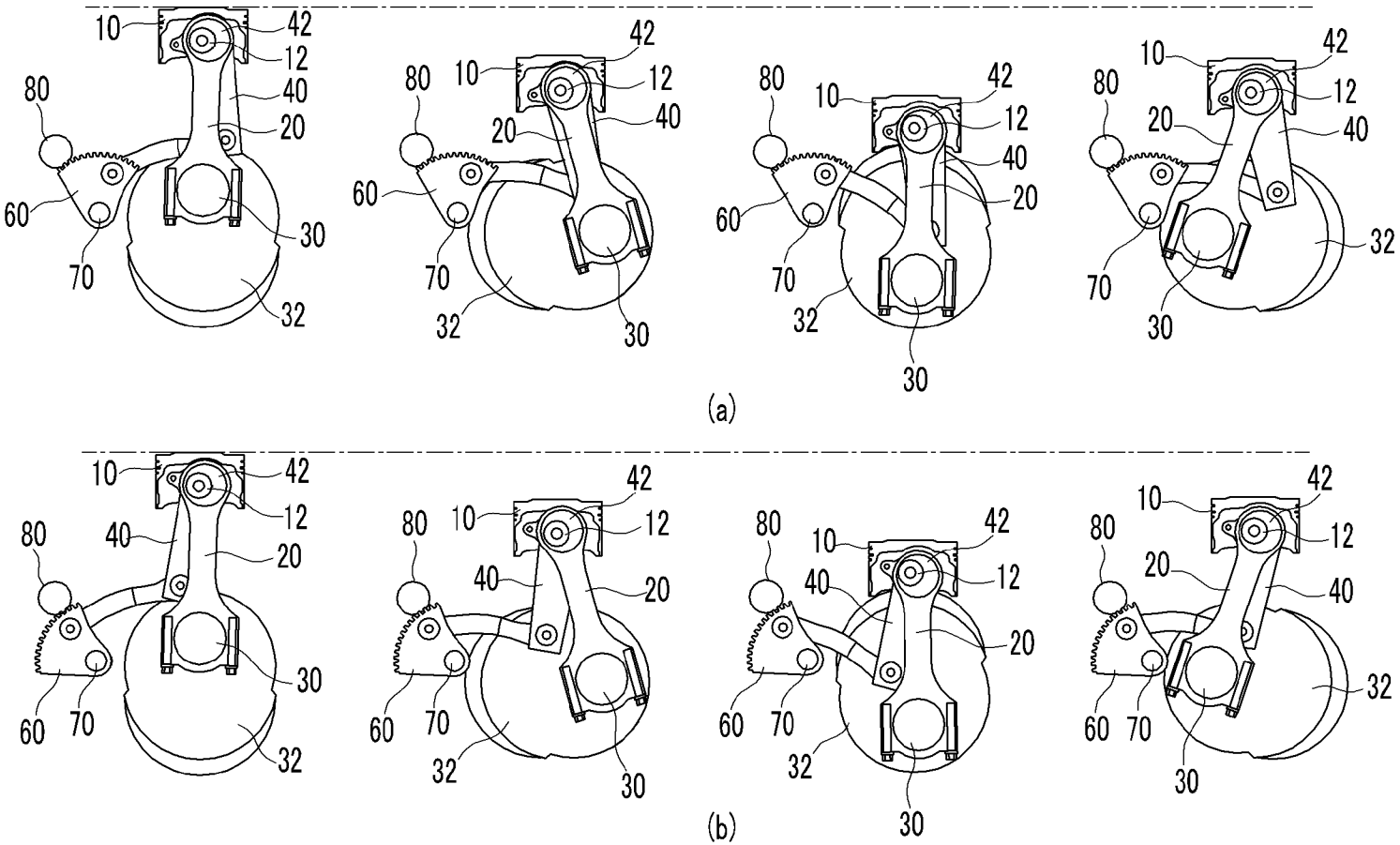
FIG. 3 is a schematic diagram showing that a variable compression ratio apparatus according to an exemplary embodiment of the present invention is operated at a low compression ratio and a high compression ratio.

As shown in FIG. 3(*a*), if the control shaft 80 rotates clockwise in a state that the variable compression ratio apparatus operates at a low compression ratio, the variable gear link 60 pivots counterclockwise and pulls the variable links 50*a* and 50*b*. Accordingly, the eccentric link 40 rotates clockwise and a position of the piston pin 12 is heightened. Therefore, the distance between the piston pin 12 and the crank pin (30) becomes longer and a high compression ratio is achieved as shown in FIG. 3(*b*).

As shown in FIG. 3(*b*), if the control shaft 80 rotates counterclockwise in a state that the variable compression ratio apparatus operates at the high compression ratio, the variable gear link 60 pivots counterclockwise and pushes the variable links 50*a* and 50*b*. Accordingly, the eccentric link 40 rotates counterclockwise and the position of the piston pin 12 is lowered. Therefore, the distance between the piston pin 12 and the crank pin becomes shorter and the low compression ratio is achieved as shown in FIG. 3(*a*).

Figure 4:
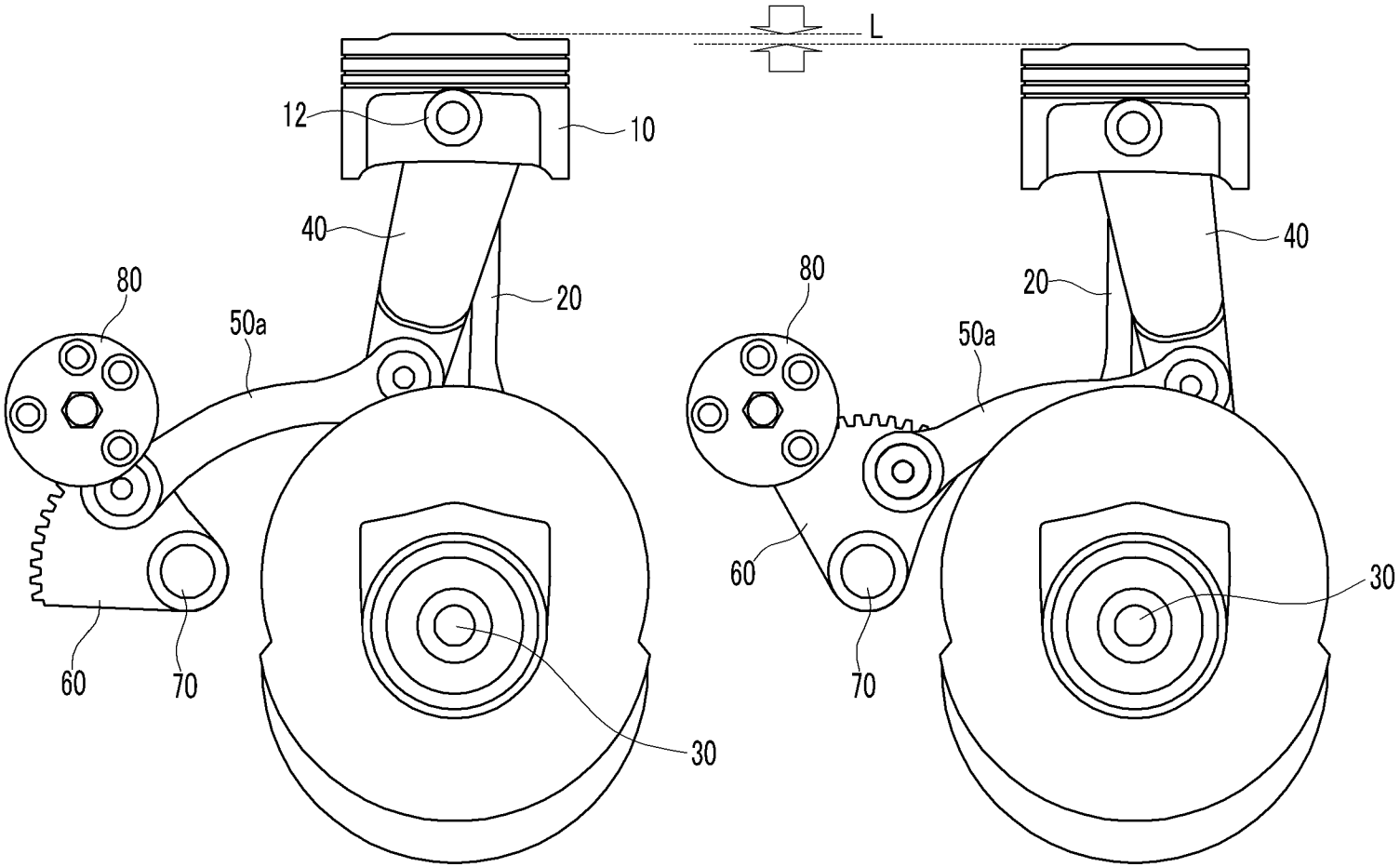
FIG. 4 is a schematic diagram showing comparison between a low compression ratio state and a high compression ratio state of a variable compression ratio apparatus according to an exemplary embodiment of the present invention.

FIG. 4 is a schematic diagram showing comparison between a low compression ratio state and a high compression ratio state of a variable compression ratio apparatus according to an exemplary embodiment of the present invention.

If the control shaft 80 rotates counterclockwise in a state that the variable compression ratio apparatus operates at the high compression ratio, the piston pin 12 is lowered by a predetermined height L by the variable gear link 60, the variable links 50*a* and 50*b*, and the eccentric link 40. Accordingly, the low compression ratio is achieved.

On the contrary, if the control shaft 80 rotates clockwise in a state that the variable compression ratio apparatus operates at the low compression ratio, the piston pin 12 is heightened by the predetermined height L by the variable gear link 60, the variable links 50*a* and 50*b*, and the eccentric link 40. Accordingly, the high compression ratio is achieved.

As described above, since a connecting rod similar to a conventional connecting rod is used according to an exemplary embodiment of the present invention, a variable compression ratio apparatus may be installed without change in a structure of a conventional engine.

In addition, durability of link members may be improved as a consequence of transmitting combustion force of an air-fuel mixture to the connecting rod directly.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus which is mounted at an engine receiving combustion force of an air-fuel mixture from a piston and rotating a crankshaft, and which changes compression ratio of the air-fuel mixture, the variable compression ratio apparatus comprising:

a connecting rod provided with one end formed of a mounting hole and the other end eccentrically and rotatably connected to the crankshaft, wherein a piston pin is inserted in the mounting hole and the one end of the connecting rod is rotatably connected to the piston through the piston pin;

an eccentric link provided with one end to which an eccentric bearing concentrically and rotatably mounted in the mounting hole is connected and the other end, the piston pin being eccentrically and rotatably mounted in the eccentric bearing;

a variable link provided with one end rotatably connected to the other end of the eccentric link and the other end;

a variable gear link configured to pivot with respect to a fixed shaft and formed of a first gear teeth at an exterior circumference thereof, an external circumferential portion thereof being rotatably connected to the other end of the variable link; and a control shaft formed of a second gear teeth engaged to the first gear teeth at an exterior circumference thereof and rotating so as to selectively pivot the variable gear link.

2. The variable compression ratio apparatus of claim 1, wherein the pivoting movement of the variable gear link according to the rotation of the control shaft rotates the eccentric link through the variable link.

3. The variable compression ratio apparatus of claim 1, wherein the variable gear link has fan shape, and the fixed shaft is positioned near a vertex of the fan shape.

4. The variable compression ratio apparatus of claim 1, wherein the variable link comprises first and second variable links, and wherein the first variable link connects a side surface of the eccentric link with a side surface of the variable gear link, and the second variable link connects the other side surface of the eccentric link with the other side surface of the variable gear link.

5. The variable compression ratio apparatus of claim 1, wherein a plurality of balance weights for reducing rotational vibration is mounted at the crankshaft, and the connecting rod, the eccentric link, the variable link, and the variable gear link are disposed between a pair of balance weights.

6. The variable compression ratio apparatus of claim 5, wherein a portion of the balance weight is trimmed considering movement traces of the eccentric link and the variable link and movement traces of corresponding crank pin and balance weight.

7. A variable compression ratio apparatus which is mounted at an engine receiving combustion force of an air-fuel mixture from a piston and rotating a crankshaft, and which changes compression ratio of the air-fuel mixture, the variable compression ratio apparatus comprising:

a connecting rod provided with one end formed of a mounting hole and the other end rotatably connected to the crankshaft so as to transmit the combustion force of the air-fuel mixture received from the piston to the crankshaft;

a control shaft selectively rotating according to a driving condition of the engine;

a variable gear link engaged with the control shaft and pivoting with respect to a fixed shaft by the rotation of the control shaft;

an eccentric link provided with one end connected to an eccentric bearing which is concentrically and rotatably mounted in the mounting hole;

a variable link connecting the other end of the eccentric link to the variable gear link and rotating the eccentric link with respect to the eccentric bearing by pivoting movement of the variable gear link; and a piston pin eccentrically inserted in the eccentric bearing and mounted in the piston so as to rotatably connect the eccentric link and the connecting rod to the piston.

8. The variable compression ratio apparatus of claim 7, wherein the variable gear link has fan shape, and the fixed shaft is positioned near a vertex of the fan shape.

9. The variable compression ratio apparatus of claim 8, wherein a first gear teeth is formed at an exterior circumference of the variable gear link, and a second gear teeth engaging with the first gear teeth is formed at an exterior circumference of the control shaft.

10. The variable compression ratio apparatus of claim 7, wherein the variable link comprises first and second variable links, and wherein the first variable link connects a side surface of the eccentric link with a side surface of the variable gear link, and the second variable link connects the other side surface of the eccentric link with the other side surface of the variable gear link.

11. The variable compression ratio apparatus of claim 7, wherein a plurality of balance weights for reducing rotational vibration is mounted at the crankshaft, and the connecting rod, the eccentric link, the variable link, and the variable gear link are disposed between a pair of balance weights.

12. The variable compression ratio apparatus of claim 7, wherein the eccentric bearing is integrally formed with the eccentric link.

13. The variable compression ratio apparatus of claim 11, wherein a portion of the balance weight is trimmed considering movement traces of the eccentric link and the variable link and movement traces of corresponding crank pin and balance weight.

14. The variable compression ratio apparatus of claim 11, wherein movements of the eccentric link and the variable link are limited by the connecting rod, a crank pin, and a trimmed portion of the balance weight so as to prevent collision therebetween.

* * * * *